US011208974B2

(12) United States Patent
Pedley et al.

(10) Patent No.: US 11,208,974 B2
(45) Date of Patent: Dec. 28, 2021

(54) FUEL PUMP

(71) Applicant: DELPHI TECHNOLOGIES IP LIMITED, St. Michael (BB)

(72) Inventors: Toby J. Pedley, London (GB); Paul Buckley, Rainham (GB); Adam Tully, Chatam (GB)

(73) Assignee: DELPHI TECHNOLOGIES IP LIMITED

( * ) Notice: Subject to any disclaimer, the term of this patent is extended or adjusted under 35 U.S.C. 154(b) by 0 days.

(21) Appl. No.: 16/961,330

(22) PCT Filed: Jan. 17, 2019

(86) PCT No.: PCT/EP2019/051176
§ 371 (c)(1),
(2) Date: Jul. 10, 2020

(87) PCT Pub. No.: WO2019/145218
PCT Pub. Date: Aug. 1, 2019

(65) Prior Publication Data

US 2020/0370523 A1 Nov. 26, 2020

(30) Foreign Application Priority Data

Jan. 26, 2018 (GB) ..... 1801350

(51) Int. Cl.

| | |
|---|---|
| ***F02M 59/02*** | (2006.01) |
| ***F02M 59/46*** | (2006.01) |
| *F02M 59/44* | (2006.01) |
| *F04B 7/02* | (2006.01) |

(52) U.S. Cl.
CPC ..... *F02M 59/02* (2013.01); *F02M 59/462* (2013.01); *F02M 59/464* (2013.01); *F02M 59/44* (2013.01); *F02M 2700/137* (2013.01); *F02M 2700/1358* (2013.01); *F04B 7/0266* (2013.01)

(58) Field of Classification Search
None
See application file for complete search history.

(56) References Cited

U.S. PATENT DOCUMENTS 1,812,013 A * 6/1931 Muzzy ..... F02M 59/14 417/148
2,260,180 A * 10/1941 Herder ..... F04B 43/02 417/571
2,421,899 A * 6/1947 Messner ..... F02M 59/44 92/130 R
2,463,486 A * 3/1949 Johnson ..... F04B 1/0408 417/205

(Continued)

FOREIGN PATENT DOCUMENTS

DE 863573 C * 1/1953 ..... F02M 59/46
DE 863573 C 1/1953

(Continued)

*Primary Examiner* — Kevin R Steckbauer
(74) *Attorney, Agent, or Firm* — Joshua M. Haines

(57) ABSTRACT

A pump body of a high pressure fuel pump defines a compression chamber in fluid communication with a first recess dug in a first outer face. A second recess is dug in a second outer face of the body. An inlet channel opens in a conduit extending between the first recess and the second recess.

15 Claims, 2 Drawing Sheets

(56) References Cited

U.S. PATENT DOCUMENTS 2,764,139 A * 9/1956 Gordon ..... F02M 49/02 123/532
2,962,974 A * 12/1960 Porkert ..... F04B 43/0045 417/571
3,077,896 A * 2/1963 Weingard ..... F16K 1/14 137/329.06
3,567,343 A * 3/1971 Erdmann ..... F02B 63/06 417/364
4,169,695 A * 10/1979 Masuda ..... F02M 37/043 417/311
4,527,961 A * 7/1985 Redwine ..... F04B 53/00 137/454.4
6,158,972 A * 12/2000 Ruth ..... F04B 25/00 417/246
6,530,363 B1 3/2003 Blass et al.
7,484,942 B2 * 2/2009 Proust ..... F04B 49/225 417/478
7,748,966 B2 * 7/2010 Vu ..... F02M 59/464 417/454
8,246,319 B2 * 8/2012 Ohnishi ..... F04B 53/22 417/273
10,677,243 B2 * 6/2020 Bubb ..... F04B 53/06
2004/0076528 A1 * 4/2004 Kolb ..... F04B 43/0733 417/244
2006/0045778 A1 * 3/2006 Proust ..... F04B 49/225 417/437
2007/0071614 A1 3/2007 Inoue
2009/0123303 A1 * 5/2009 Ohnishi ..... F04B 53/143 417/270
2009/0272364 A1 * 11/2009 Vu ..... F02M 59/464 123/495
2015/0110654 A1 * 4/2015 Bubb ..... F04B 13/00 417/435
2020/0400140 A1 * 12/2020 Bayyouk ..... F04B 53/1087

FOREIGN PATENT DOCUMENTS

DE 10229395 A1 * 1/2004 ..... F02M 63/0028
DE 10229395 A1 1/2004
DE 102004039484 A1 2/2006
DE 102007038519 A1 1/2009
DE 102011084356 A1 4/2013
JP 11082236 A 3/1999
WO 2015183278 A1 12/2015
WO WO-2015183278 A1 * 12/2015 ..... F04B 1/0421

* cited by examiner

FUEL PUMP

CROSS REFERENCE TO RELATED APPLICATIONS

This application is a national stage application under 35 USC 371 of PCT Application No. PCT/EP2019/051176 having an international filing date of Jan. 17, 2019, which is designated in the United States and which claimed the benefit of GB Patent Application No. 1801350.8 filed on Jan. 26, 2018, the entire disclosures of each are hereby incorporated by reference in their entirety.

TECHNICAL FIELD

The present invention relates a high pressure fuel pump wherein the inlet and outlet valves are interchangeable.

BACKGROUND OF THE INVENTION

Fuel injection pumps, diesel or gasoline, comprise a pumping head and cambox. The head requires inlet and outlet valves providing fuel flow to and from a high pressure compression chamber. In recent years the outlet connection from the pump has come directly from the pumping head. Distinct orientation preferences are a vertical outlet or a horizontal outlet. These two configurations require different pump head designs because when the outlet is vertical the inlet is horizontal and when the outlet is horizontal a convenient position for the inlet, to minimize machining operations, is vertical.

SUMMARY OF THE INVENTION

Accordingly, it is an object of the present invention to resolve the above mentioned problems in providing a unique pump body of a high pressure fuel pump of a fuel injection equipment of an internal combustion engine. Said pump body is provided with a bore extending along a pumping axis between a lower end opening in a lower face of the body and an upper end partially defining a compression chamber. The body is further provided with:

a first recess dug in a first outer face of the body and having a lateral face extending along a first axis toward a bottom that is in fluid communication with said compression chamber and, a second recess dug in a second outer face of the body and having a lateral face extending along a second axis toward a bottom that is also in fluid communication with said compression chamber and, a between-recesses-conduit extending between said first recess where it opens in its lateral face and said second recess where it also opens in its lateral face so that said recesses are in permanent fluid communication with one another and with, an inlet channel in which, in use, a fuel at a relatively low pressure enters the pump, said inlet channel opening in said between-recesses-conduit.

In another aspect of the invention, the bore may open in the bottom of the first recess, said bottom being limited to a sealing shoulder surrounding said bore opening.

In another aspect of the invention, an inner conduit may extend between the compression chamber and the bottom of the second recess, said bottom being limited to a sealing shoulder surrounding said the opening of said inner conduit.

The lateral face of the first recess may be threaded.

The lateral face of the second recess may be threaded.

The first axis and the second axis may be perpendicular.

The first axis and the pumping axis may be coincident.

The first recess and the second recess may have identical dimensions.

An inlet valve assembly is arranged in one of the two recesses and, an outlet valve assembly is arranged in the other recess.

The invention extends to a high pressure pump wherein the inlet valve assembly comprises a seat member pressed against the sealing shoulder by a plug sealingly screwed in the recess.

The inlet valve assembly may comprise a seat-and-valve assembly itself comprising:

the seat member that is provided with an axial through hole and at least one side drilling defining an inlet conduit extending between the lateral face of the seat member and said axial through hole and, a poppet valve member having a head defined at an end of a stem, the stem being axially guided in said axial through hole, the head protruding on an inner face of the seat member where it cooperates with an inlet seat face defined on said inner face of the seat member and the stem protruding on an opposite outer face, said assembly further comprising a spring compressed between said outer face of the seat member and a spring seat fixed to the valve so that, the head is pulled in a closed position of said inlet seat.

The seat member may further be provided with a lip defining a circular sharp edge pressed in sealing contact against said sealing shoulder.

The outlet valve assembly is an integral cartridge having a tubular body defining a lateral face extending between an inner transverse face and an outer end, and being provided with an inner outlet conduit opening at both ends of the body, the lateral face being threaded and complementary tightened in the recess, a check valve being arranged in said outlet conduit.

The outlet valve assembly may be arranged in the first recess and the inlet valve assembly is arranged in the second recess.

In another alternative, the outlet valve assembly is arranged in the second recess and the inlet valve assembly is arranged in the first recess.

BRIEF DESCRIPTION OF THE DRAWINGS

The present invention is now described by way of example with reference to the accompanying drawings in which.

DESCRIPTION OF THE PREFERRED EMBODIMENTS

Figure 1:
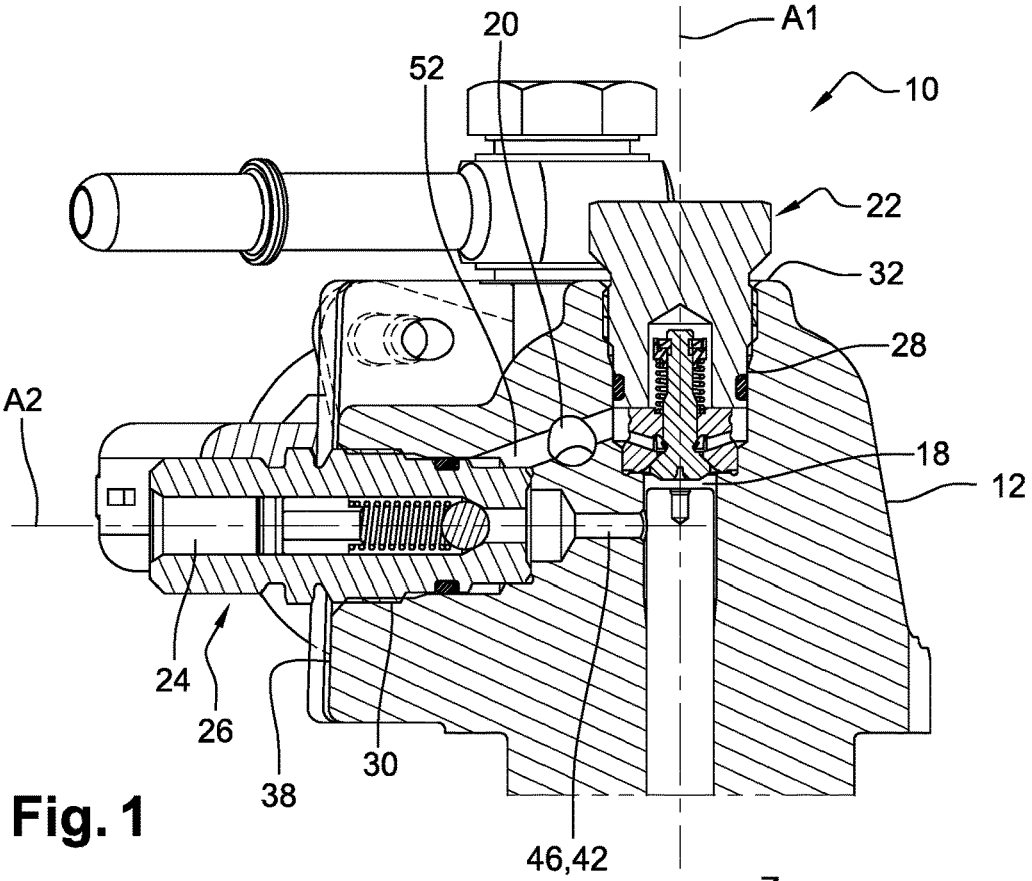
FIG. 1 is a section of a pump head as per the invention arranged as per a first configuration.

In reference to figures is described a high pressure (HP) fuel pump 10 which typically comprises a pumping head arranged over a cambox, not shown. In use said pump 10 is arranged in a fuel injection equipment of an internal combustion engine wherein fuel stored in a tank is drawn and flown to the pump 10 wherein it is pressurized then delivered to a HP reservoir, known as a common rail, wherefrom fuel is distributed to fuel injectors.

The fuel pump 10 has a body 12 provided with a bore 14 wherein is guided a piston 16.

The pump 10 taken in example to illustrate the invention and shown on the figures, is a diesel fuel pump comprising a pump head, partially shown, arranged and fixed on a cambox not shown. Other pumps, diesel or gasoline, integrate within a single component the pumping head and the cambox or other actuation device. To simplify and clarify the description, the body 12 shown is the body of a pump head and is more generally identified as being the pump body.

Along a pumping axis Z, which once installed on a vehicle is often vertical, the bore extends from an inner end, defining a compression chamber 18, to a lower end, not shown, opening in said cambox. The piston 16 is an elongated stem extending between an upper end, partially defining said compression chamber 18 and, a lower end protruding outside the bore into the cambox where is cooperates with a rotating camshaft. In the bore, the piston reciprocates between BDC and TDC and it varies cyclically the volume of the compression chamber 18 wherein fuel at low pressure enters via an inlet channel 20 controlled by an inlet valve assembly 22 and exits after being pressurized, via an outlet channel 24 controlled by an outlet valve assembly 26.

The inlet valve assembly 22 defines a cartridge tightened in a recess provided in the body 12 of the pump and, the outlet valve assembly 26 also forms a cartridge tightened in another recess provided in the body 12.

Said inlet and outlet cartridges are similar and can be positioned indifferently in a recess or the other. In FIG. 1, the inlet valve assembly 22 is arranged in a first recess 28 extending along a first axis A1 that in the embodiment presented is coincident to the "vertical" or pumping axis Z, said first recess 28 being coaxial and aligned to the bore 14 and, the outlet valve assembly 26 is arranged in a second recess 30 extending perpendicular to the bore 14 along an second axis A2 which is an "horizontal" axis.

Figure 2:
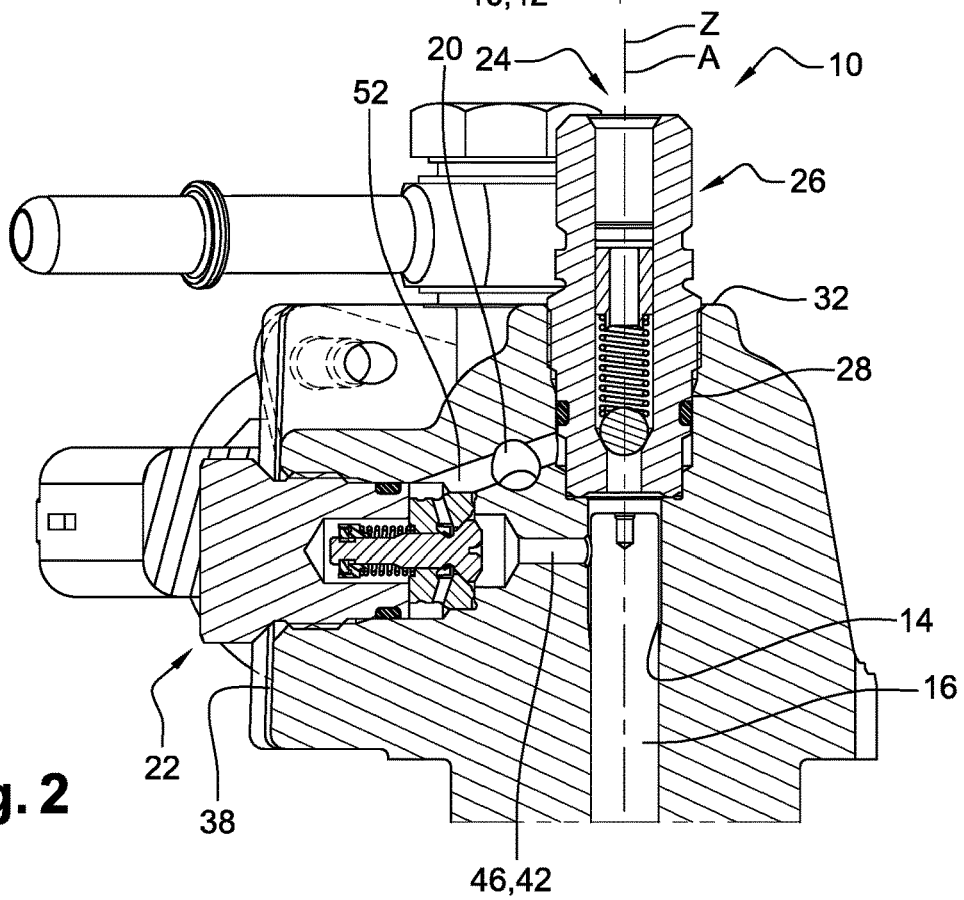
FIG. 2 is the pump of FIG. 1 arranged as per a second configuration.

In FIG. 2, the body 12 is the same and the arrangement is opposite with the outlet valve assembly 26 arranged in a first recess 28 aligned to the bore 14 and, the inlet valve assembly 22 arranged in a second recess 30 perpendicular to the bore. Parallel and perpendicular to the bore 14 are preferred but are in no way limiting and some other angles may offer their own advantages The first recess 28 opens on an outer face 32, or upper face 32 of the body 14 and, extending along said first axis A1 it defines a lateral face 34 substantially cylindrical extending toward the bottom of the recess. Close to said upper face 32, the lateral face 34 is threaded and, in the bottom of the recess, the bore 14 centrally opens limiting said bottom to the peripheral annular area surrounding the opening of the bore and defining a first sealing shoulder 36. Alternatively to a central opening that is easier to design and to manufacture, the bore can open with an offset, provided said bore opening is still surrounded by a peripheral annular area defining a sealing shoulder.

The second recess 30 is similar to the first recess 28, opening on another outer face 38, or a side face 38 of the body 12 and, extending along said second axis A2 it defines a lateral face 40 substantially cylindrical extending toward the bottom of the recess. Close to said body side face 38, the second recess lateral face 40 is also threaded to the same diameter and same pitch as the first recess and, in the bottom of the recess, an inner channel 42 centrally opens limiting the bottom face to the peripheral annular area surrounding the opening of said inner channel 42 defining a second sealing shoulder 44.

The inner channel 42 joins said second recess 30 to the compression chamber 18, and it comprises a narrow portion 46 communicating with the compression chamber and, an enlarged portion 48 opening in the bottom of the second recess. The enlargement 48 is in this embodiment because the valve 78,76 is proud of the surface 36 in this embodiment. In case of the valve 78,76 being recessed relative to surface 36 then the enlargement 48 may not be needed.

To ensure the interchangeability of the inlet valve assembly 22 and the outlet valve assembly 26, the first 28 and second 30 recesses are substantially identical with same diameters, same threads, same depths measured between the thread and the sealing shoulder.

Moreover, the pump inlet channel 20 opens in a conduit 52 drilled between the two recesses and opening at both ends in the lateral faces 34, 40 of the recesses. In use, an inlet metering valve (IMV) arranged downstream said inlet channel 20 allows a fuel quantity needed to fulfil the engine demand to flow in said channel 20 and then in said between-recesses-conduit 52. The channels 20 and 52 forming essentially a T shape, it will be appreciated that a Y shape can also be used to the same effect.

Figure 3:
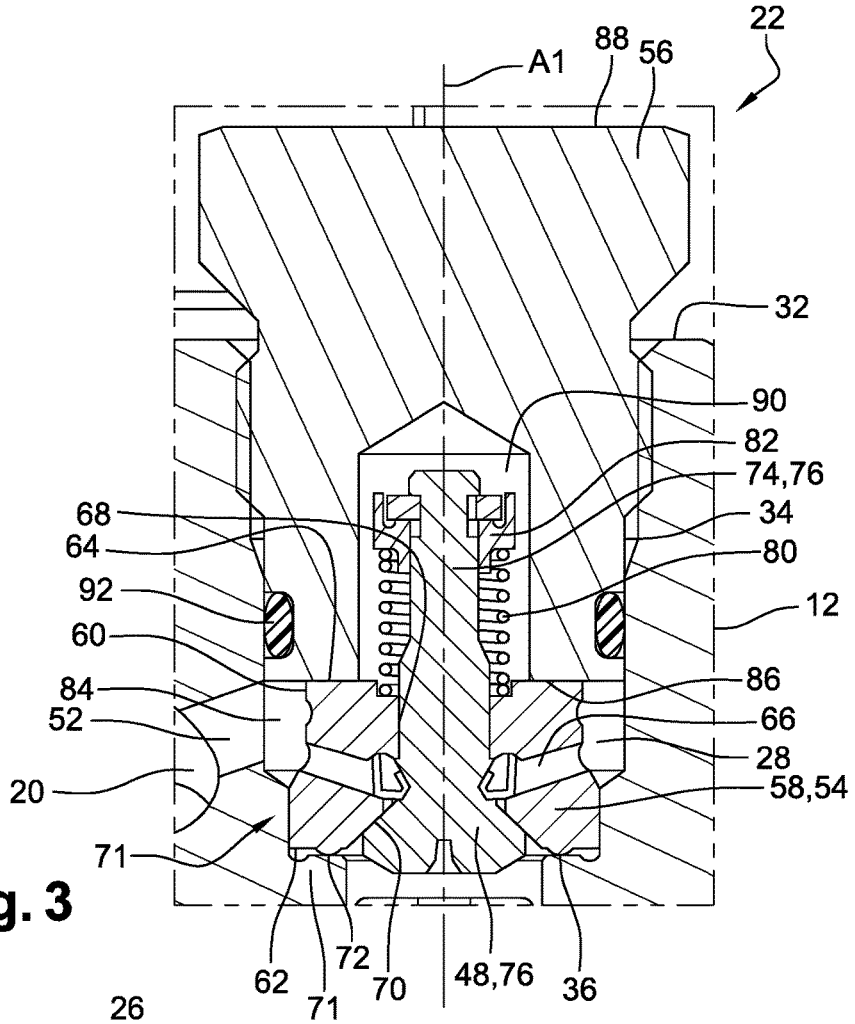
FIG. 3 is a magnified view of the inlet valve assembly of the pump.

In reference to the arrangement shown on FIG. 1, the inlet valve assembly 22, better shown on FIG. 3, is arranged in the first recess 28 and it comprises a seat-and-valve assembly 54 pressed against the sealing shoulder 36 by a plug 56 screwed in the thread of the recess. The seat-and-valve assembly 54 itself comprises a cylindrical seat member 58 having a lateral face 60 extending between an inner face 62 arranged against the sealing shoulder, and an opposed outer face 64, said seat member 58 being provided with an axial through hole extending between said inner and outer faces, and also with at least one side drilling 66 extending between said lateral face 60 and said through hole. The outer portion of the through hole, between the outer face 64 and said side drilling 66 defines a guiding bore 68 and, the opposed inner portion enlarges to define a conical seat face 70 that opens in the inner face 62. Also, as shown, to center the seat member in the recess, said recess narrows at the bottom to a diameter adjusted to the diameter of the seat member 58, the sealing shoulder 36 being defined at the bottom of said narrow end 71.

From said seat member inner face 62 rises an annular lip having a sharp edge 72, also known as a "knife edge", sealingly pressed against the sealing shoulder 36.

The seat-and-valve assembly 54 further comprises a poppet valve 74 having a stem 76 extending in said through hole wherein it is guided in the outer guiding bore 68 protruding from the inner face 62 and defining an enlarged head 78 cooperating with the seat face 70 and, protruding on the other side from the outer face 64. A spring 80 is engaged around the stem and is compressed between the outer face 64 of the seat member and an annular spring seat 82 fixed at the end of the stem so that the poppet valve 74 is pulled in a closed position, the head 78 being in sealing contact against the seat face 70.

As shown on the figure, the side drilling 66 open on the lateral face 60 of the seat member above said narrow end 71 of the recess in an enlarged portion of the recess that defines an annular void 84 surrounding the seat member, the between-recesses-conduit 52 also opening in said void 84.

The plug 56 is a screw tightened in the recess and extending in the recess toward an inner face 86 urged against the seat member outer face 64 and, outside the recess toward an opposed outer face 88. Said inner face 86 is limited to the annular peripheral area by a central blind hole 90 enabling the extension of the stem 76 of the poppet valve. For avoiding pressure rises in the hole 90, a vent, not shown, is drilled between hole 90 and chamber 84. The plug 56 is further provided with an o-ring 92 arranged in an annular groove defined around said plug close to its inner face 86, said o-ring 92 sealing the recess against any fuel leak. When tightening the plug 56, the seat member 58 is pressed at the bottom of the recess and the knife edge 72 complementary marks the sealing shoulder 36 ensuring sealing around the seat face 70.

Figure 4:
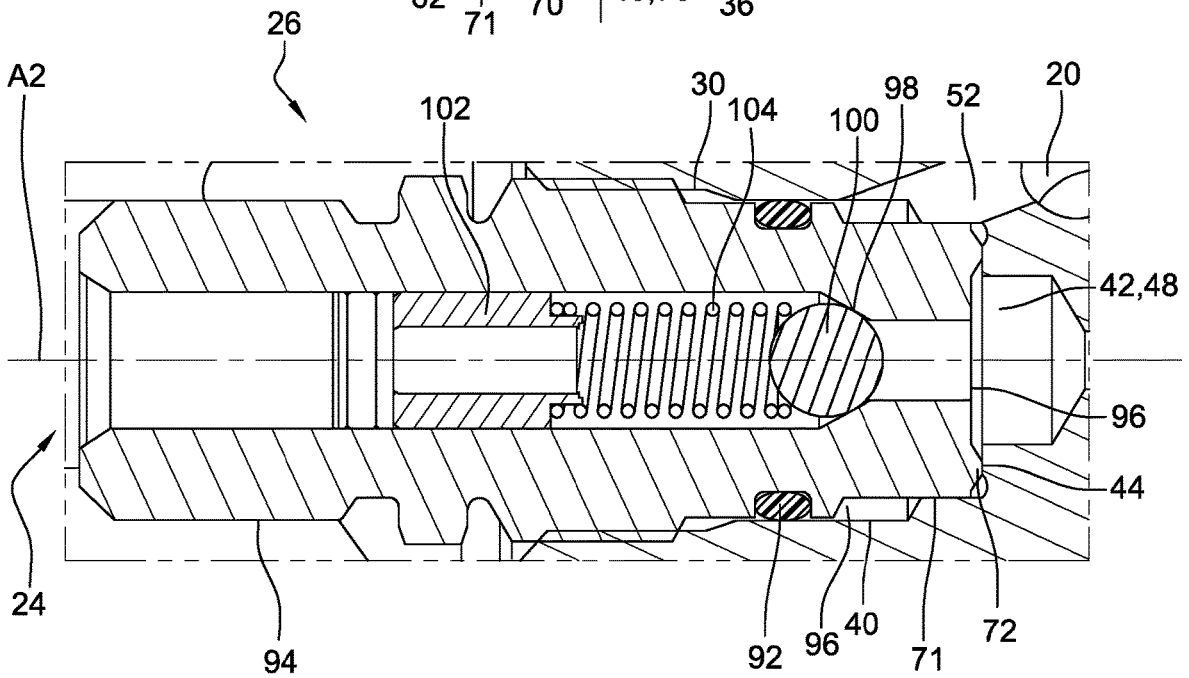
FIG. 4 is a magnified view of the outlet valve assembly of the pump.

The outlet valve assembly 26 better shown on FIG. 4 as per the configuration of FIG. 1, is arranged in the horizontal second recess 30. Said outlet valve assembly 26 is an integrated cartridge having a tubular body 94 which outer face has the same characteristics and dimensions as the inlet plug 56 and seat member 58. Said body 94 outer face is threaded and tightened in the recess and it extends in the recess toward an inner face 96, identical to the inner face 62 of the seat member, with an annular lip defining a knife-edge 72 pressed against the sealing shoulder. The inner end of the body 94 is thinner and adjusted to the narrow end 71 of the recess and, said thinner inner end of the body extends beyond said narrow end 71 of the recess so that it defines with the recess another annular void 96 surrounding the outlet valve body and in which also opens the between-recesses-conduit 52. Beyond said void, the outlet valve assembly 26 is also provided with an o-ring 92 that seals any clearance between the body and the recess. The chamber 96 delimited by the o-ring 92 and knife edge 72 closes off the unused end of the conduit 52. Therefore the conduits 20, 52 can be equally arranged to both bores 28, 30 in the aforementioned T or Y pattern. In normal use there will be no flow past the knife edge 72 but any unintended leakage is returned to the conduit 52.

The tubular body 94 is internally provided with a through hole defining said outlet channel 24, said hole itself enlarging and defining an outlet seat 98. In said outlet channel 24 are arranged a ball 100, a tubular spring retainer 102 fixed by press-fit inside the channel 24, and a spring 104 compressed between said retainer 102 and the ball 100 so that the ball is urged against the outlet seat 98.

The present example describes a pump wherein the inlet valve and outlet valve are interchangeable. In an alternative not shown, said valves may differ from one another and not be interchangeable. Said alternative would still have the interest of manufacturing the pump body independently from the valves eliminating the risk of scrapping an entire pump body because of a valve face geometry not being to print.

Key steps of the operation of the pump 10 are now described.

In said arrangement the inlet valve assembly is fixed in the first recess and, the outlet valve assembly is fixed in the second recess.

In a first step, the piston moves from TDC to BDC, the volume of the compression chamber increases and the pressure therein drops aspiring the poppet valve 74 in an open position. Fuel at low pressure exits the pump inlet channel 20 and flows in the between-recesses-conduit 52 wherefrom it fills the two annular voids 84, 96 around the inlet valve and around the outlet valve. The void 96 around the outlet valve assembly is sealed by the o-ring 92 and the knife-edge 72 and, fuel flowing in the conduit 52 can only go toward the other void 84 around the inlet wherein fuel flows in the side drillings 66 of the seat member then between the seat 70 and the poppet head 78 finally filling the compression chamber 18.

In a subsequent second step, the piston 16 moves from BDC to TDC, the volume of the compression chamber 18 reduces, raising the pressure and pushing the inlet valve back in a closed position where the poppet head 78 is in sealing contact against the seat face 70. In closing the inlet valve, the conduit 52 is closed at both ends. The pressure in the compression chamber exerts an opening force on the ball 100 of the outlet valve said force acting against the closing force of the spring 104. As the piston moves towards TDC, the pressure in the compression chamber reaches a predetermined threshold where said opening force overcomes the spring force and pushes the ball 100 away from the outlet seat 98 enabling the pressurised fuel to exit the compression chamber and flow in the outlet channel 24.

In a diesel system, said predetermined threshold may be around 3000 bars and, should some small quantity of fuel still find a way to leak through the knife edge 72, either on the inlet or outlet side, said fuel leak would drop in pressure on the other side to the lip and would join the voids 84, 96 where it would mix with the other low pressure fuel waiting for the inlet valve to open.

Thanks to said arrangement, a single type of pump body 12 provided with two identical recesses 28, 30 and the T or Y connection 20, 52 enables the arrangement of two configurations of pump 10. Moreover, the inlet valve assembly 22 can be pre-assembled, tuned and calibrated independently of the pump. Similarly, the outlet valve assembly 26 can also be pre-assembled, tuned and calibrated independently of the pump.

In alternative not shown, the first recess 28 may not be aligned to the bore 14, the first axis A1 being angled relative to the pumping axis Z and, the second recess 30 may not be "horizontal", the second axis A2 not being perpendicular to the pumping axis Z of the bore. It is also possible for both recesses 28, 30 to be in a plane perpendicular to the bore, said recesses being oriented in any horizontal direction.

LIST OF REFERENCES

Z pumping axis-vertical axis
A1 first axis
A2 second axis
BDC bottom dead center
TDC top dead center
10 pump
12 body of the pump
14 bore
16 piston
18 compression chamber
20 inlet channel
22 inlet valve assembly
24 outlet channel
26 outlet valve assembly
28 first recess
30 second recess
32 first outer face-upper face of the body
34 lateral face of the first recess
36 first sealing shoulder
38 second outer face-side face of the body
40 lateral face of the second recess
42 inner channel
44 second sealing shoulder
46 narrow portion
48 enlarged portion

52 between-recesses-conduit
54 seat-and-valve assembly
56 plug
58 seat member
60 lateral face
62 inner face
64 outer face
66 side drilling
68 guiding bore
70 inlet seat
71 narrow end of the recess
72 knife edge-lip sharp edge
74 poppet valve
76 stem
78 head
80 spring
82 spring seat
84 void
86 inner face of the plug
88 outer face of the plug
90 blind hole
92 o-ring
94 body of the outlet valve
96 void
98 outlet seat
100 ball
102 retainer
104 spring

The invention claimed is:

1. A pump body of a high pressure fuel pump of a fuel injection equipment of an internal combustion engine, said pump body comprising:

a bore extending along a pumping axis between a lower end opening in a lower face of the pump body and an upper end partially defining a compression chamber;

a first recess dug in a first outer face of the pump body and having a first lateral face extending along a first axis toward a first bottom that is in fluid communication with said compression chamber;

a second recess dug in a second outer face of the pump body and having a second lateral face extending along a second axis toward a second bottom that is also in fluid communication with said compression chamber;

a between-recesses-conduit extending between said first recess where it opens in said first lateral face and said second recess where it opens in said second lateral face so that said first recess and said second recess are in permanent fluid communication with one another; and an inlet channel in which, in use, a fuel at a relatively low pressure enters the high pressure fuel pump, said inlet channel opening in said between-recesses-conduit such that said inlet channel intersects with said between-recess-conduit at a location between said first recess and said second recess.

2. A pump body as claimed in claim 1, wherein the bore opens in the first bottom of the first recess, said first bottom being limited by a sealing shoulder surrounding where said bore opens in the first bottom of the first recess.

3. A pump body as claimed in claim 1, wherein an inner conduit extends between the compression chamber and the second bottom of the second recess, said second bottom being limited to a sealing shoulder surrounding said an opening of said inner conduit.

4. A pump body as claimed in claim 1, wherein the first lateral face of the first recess is threaded.

5. A pump body as claimed in claim 1, wherein the second lateral face of the second recess is threaded.

6. A pump body as claimed in claim 1, wherein the first axis and the second axis are perpendicular to each other.

7. A pump body as claimed in claim 1, wherein the first axis and the pumping axis are coincident.

8. A pump body as claimed in claim 1, wherein the first recess and the second recess have identical dimensions.

9. A high pressure pump comprising:

a pump body having:

a bore extending along a pumping axis between a lower end opening in a lower face of the pump body and an upper end partially defining a compression chamber;

a first recess dug in a first outer face of the pump body and having a first lateral face extending along a first axis toward a first bottom that is in fluid communication with said compression chamber;

a second recess dug in a second outer face of the pump body and having a second lateral face extending along a second axis toward a second bottom that is also in fluid communication with said compression chamber;

a between-recesses-conduit extending between said first recess where it opens in said first lateral face and said second recess where it opens in said second lateral face so that said first recess and said second recess are in permanent fluid communication with one another; and an inlet channel in which, in use, a fuel at a relatively low pressure enters the high pressure fuel pump, said inlet channel opening in said between-recesses-conduit such that said inlet channel intersects with said between-recess-conduit at a location between said first recess and said second recess;

an inlet valve assembly arranged in either the first recess or the second recess; and an outlet valve assembly arranged in the other of the first recess and the second recess in which the inlet valve assembly is not arranged.

10. A high pressure pump as claimed in claim 9, wherein:

the bore opens in the first bottom of the first recess, said first bottom being limited byte a first sealing shoulder surrounding where said bore opens in the first bottom of the first recess an inner conduit extends between the compression chamber and the second bottom of the second recess, said second bottom being limited to a second sealing shoulder surrounding said an opening of said inner conduit; and the inlet valve assembly comprises a seat member pressed against either the first sealing shoulder or the second sealing shoulder by a plug sealingly screwed in either the first recess or the second recess.

11. A high pressure pump as claimed in claim 10, wherein the inlet valve assembly comprises a seat-and-valve assembly comprising:

the seat member that is provided with an axial through hole and at least one side drilling, defining an inlet conduit extending between a lateral face of the seat member and said axial through hole;

a poppet valve member having a head defined at an end of a stem, the stem being axially guided in said axial through hole, the head protruding on an inner face of the seat member where it cooperates with an inlet seat face defined on said inner face of the seat member, and the stem protruding on an opposite outer face of the seat member; and a spring compressed between said opposite outer face of the seat member and a spring seat fixed to the poppet valve member such that the head is pulled in a closed position of said inlet seat face.

12. A high pressure pump as claimed in claim 11, wherein the seat member is further provided with a lip defining a circular sharp edge pressed in sealing contact against said first sealing shoulder or said second sealing shoulder.

13. A high pressure pump as claimed in claim 9, wherein the outlet valve assembly is an integral cartridge having a tubular body defining a lateral face extending between an inner transverse face and an outer end, and being provided with an inner outlet conduit opening at both ends of the tubular body, the lateral face of the tubular body being threaded and complementary tightened in either the first recess or the second recess, a check valve being arranged in said inner outlet conduit.

14. A high pressure pump as claimed in claim 9, wherein:

the first axis and the second axis are perpendicular to each other;

wherein the first axis and the pumping axis are coincident;

wherein the first recess and the second recess have identical dimensions; and wherein the outlet valve assembly is arranged in the first recess and the inlet valve assembly is arranged in the second recess.

15. A high pressure pump as claimed in claim 9, wherein:

the first axis and the second axis are perpendicular to each other;

wherein the first axis and the pumping axis are coincident;

wherein the first recess and the second recess have identical dimensions; and wherein the outlet valve assembly is arranged in the second recess and the inlet valve assembly is arranged in the first recess.

* * * * *